US009919862B2

(12) United States Patent
Smith et al.

(10) Patent No.: US 9,919,862 B2
(45) **Date of Patent: *Mar. 20, 2018**

(54) RECYCLABLE PLASTIC AEROSOL DISPENSER

(71) Applicant: The Procter & Gamble Company, Cincinnati, OH (US)

(72) Inventors: Scott Edward Smith, Cincinnati, OH (US); Douglas Bruce Zeik, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/049,361

(22) Filed: Feb. 22, 2016

(65) Prior Publication Data

US 2016/0167867 A1 Jun. 16, 2016

Related U.S. Application Data

(63) Continuation of application No. 14/061,149, filed on Oct. 23, 2013, now Pat. No. 9,296,550.

(51) Int. Cl.

| | |
|---|---|
| ***B65D 83/32*** | (2006.01) |
| ***B65D 83/38*** | (2006.01) |
| ***B65D 83/48*** | (2006.01) |
| ***B65D 83/62*** | (2006.01) |
| ***B65D 83/70*** | (2006.01) |
| ***B65D 83/14*** | (2006.01) |
| ***B65D 83/44*** | (2006.01) |
| *B65D 35/22* | (2006.01) |
| *B65D 77/06* | (2006.01) |

(52) U.S. Cl.
CPC ..... *B65D 83/38* (2013.01); *B65D 83/14* (2013.01); *B65D 83/32* (2013.01); *B65D 83/44* (2013.01); *B65D 83/48* (2013.01); *B65D 83/62* (2013.01); *B65D 83/752* (2013.01); *B65D 35/22* (2013.01); *B65D 77/065* (2013.01)

(58) Field of Classification Search
CPC ..... B65D 35/22; B65D 83/62; B65D 77/065; B65D 83/14; B65D 83/32; B65D 83/38; B65D 83/48; B65D 83/752; B65D 83/44
See application file for complete search history.

(56) References Cited

U.S. PATENT DOCUMENTS 2,863,699 A 12/1959 Elser
3,333,743 A 8/1967 Charles
(Continued)

FOREIGN PATENT DOCUMENTS

WO WO 91/08099 A1 6/1991
WO WO 2007/140398 A2 12/2007

OTHER PUBLICATIONS

Spray Technology & Marketing, Apr. 2009; Scott Smith; 6 Pages. Downlaoded Dec. 19, 2013; http://www.spraytm.com/expanding-the-aerosol-marketplace-through-plastic-innovation.html.

*Primary Examiner* — Frederick C Nicolas
(74) *Attorney, Agent, or Firm* — Larry L. Huston

(57) ABSTRACT

An aerosol dispenser. The aerosol dispenser is made from materials which can go into a single recycling stream having a single class of materials, as defined by the Society of the Plastics Industry, and particularly may exclusively comprise Class 1 materials with no flammable product/propellant present.

20 Claims, 2 Drawing Sheets

(56) References Cited

U.S. PATENT DOCUMENTS 3,403,804 A 10/1968 Colombo
3,450,254 A 6/1969 Miles
4,073,398 A 2/1978 Schultz
4,330,066 A 5/1982 Berliner
4,964,540 A 10/1990 Katz
4,969,577 A 11/1990 Werding
5,111,971 A 5/1992 Winer
5,248,063 A 9/1993 Abbott
5,927,551 A 7/1999 Taylor et al.
6,019,252 A 2/2000 Benecke et al.
6,070,770 A * 6/2000 Tada ..... B65D 83/44 222/402.1
6,196,275 B1 3/2001 Yazawa et al.
6,254,820 B1 7/2001 Cornell
6,394,364 B1 * 5/2002 Abplanalp ..... B05B 7/2424 222/145.1
7,028,866 B2 4/2006 Kunesh et al.
7,303,087 B2 12/2007 Flashinski et al.
7,387,121 B2 6/2008 Harvey
7,451,899 B2 11/2008 De Pous
7,757,902 B2 7/2010 Bevans et al.
8,025,189 B2 9/2011 Salameh
8,074,847 B2 12/2011 Smith
8,464,914 B2 6/2013 Lulla et al.
8,752,731 B2 6/2014 Nimmo et al.
9,296,550 B2 * 3/2016 Smith ..... B65D 83/14
2007/0245538 A1 10/2007 Salameh
2007/0278253 A1 * 12/2007 Ruiz De Gopegui ..... B65D 83/205 222/402.13
2008/0257846 A1 10/2008 Hove et al.
2008/0257883 A1 10/2008 Van Hove et al.
2008/0272145 A1 11/2008 Nimmo et al.
2008/0314475 A1 12/2008 Fransen
2009/0014679 A1 1/2009 Hygema et al.
2009/0045222 A1 2/2009 Nimmo et al.
2009/0068385 A1 3/2009 Hill
2010/0200612 A1 8/2010 Smith
2010/0239799 A1 9/2010 Van Hove et al.
2010/0252583 A1 10/2010 Maas et al.
2010/0264165 A1 10/2010 Hansen et al.
2010/0330313 A1 12/2010 Van Hove et al.
2011/0017701 A1 1/2011 Soliman
2011/0024450 A1 2/2011 Maas et al.
2011/0083955 A1 4/2011 Tirtowidjojo
2011/0192865 A1 8/2011 Jung
2011/0248035 A1 9/2011 Peirsman
2012/0132607 A1 5/2012 Landman et al.
2012/0157779 A1 6/2012 Fischvogt
2012/0187067 A1 7/2012 Maas et al.
2012/0292338 A1 11/2012 Smith
2013/0068243 A1 3/2013 Birkel et al.
2013/0270295 A1 10/2013 Collias et al.

* cited by examiner

RECYCLABLE PLASTIC AEROSOL DISPENSER

FIELD OF THE INVENTION

The present invention relates to aerosol dispensers and the manufacture of components thereof.

BACKGROUND OF THE INVENTION

Aerosol dispensers are well known in the art. Aerosol dispensers typically comprise an outer container which acts as a frame for the remaining components and as a pressure vessel for propellant and product contained therein. Outer containers made of metal are well known in the art. However, metal containers can be undesirable due to high cost and limited recyclability. Attempts to use plastic have occurred in the art. Relevant attempts in the art to employ plastic in aerosol dispensers are found in U.S. Pat. Nos. 2,863,699; 3,333,743 and 2009/0014679.

The outer containers are typically, but not necessarily, cylindrical. The outer container may comprise a bottom for resting on horizontal surfaces such as shelves, countertops, tables etc. The bottom of the outer container may comprise a re-entrant portion as shown in U.S. Pat. No. 3,403,804. Sidewalls defining the shape of the outer container extend upwardly from the bottom to an open top.

The open top defines a neck for receiving additional components of the aerosol dispenser. The industry has generally settled upon a neck diameter of 2.54 cm, for standardization of components among various manufacturers, although smaller diameters, such as 20 mm, are also used. Various neck shapes are shown in US 2007/02782531 A1; U.S. Pat. Nos. 7,303,087; 7,028,866; and commonly assigned U.S. Pat. No. 6,019,252.

Typically a valve cup is inserted into the neck. The valve cup is sealed against the neck to prevent the escape of the propellant and loss of pressurization. The valve cup holds the valve components which are movable in relationship to the balance of the aerosol dispenser.

Aerosol dispensers, having a valve cup and movable valve components, may comprise different embodiments for holding, storing, and dispensing product used by the consumer. In one embodiment, the product and propellant are intermixed. When the user actuates the valve, the product and propellant are dispensed together. This embodiment may utilize a dip tube. The dip tube takes the product and propellant mixture from the bottom of the outer container. By dispensing from the bottom of the outer container, the user is more likely to achieve dispensing of the product/propellant mixture and not dispense pure propellant from the headspace. This embodiment may be used, for example, to dispense shaving cream foams.

The dip tube embodiment of an aerosol dispenser has the disadvantage that when the user tips the aerosol dispenser from a vertical orientation, dispensing of gas from the headspace, rather than dispensing of product/propellant mixture, may occur. This disadvantage may occur when the aerosol dispenser contains a product such as a body spray, which the user dispenses all over his/her body, often from inverted positions.

To overcome this disadvantage, other embodiments could be utilized. For example, a collapsible, flexible bag may be sealed to the opening on the underside of the valve cup or may be placed between the valve cup and the container. This bag limits or even prevents intermixing of the contents of the bag and the components outside of the bag. Thus, product may be contained in the bag. Propellant may be disposed between the outside of the bag and the inside of the outer container. Upon actuation of the valve, a flow path out of the bag is created. Gage pressure from the propellant disposed between the bag and the outer container causes pressurization of the product, forcing the product to flow into ambient pressure. This embodiment is commonly called a bag on valve and may be used, for example, in dispensing shaving cream gels. In either embodiment, flow to the ambient may comprise droplets, as used for air fresheners or may comprise deposition on a target surface, as may occur with cleansers. An aerosol container having a bag therein may be made from a plural layer preform, provided both layers consist of or consist essentially of the same recycling stream. A plural layer preform may have plural layers disposed one inside the other, and particularly two layers as occurs in a dual layer preform. These layers may be generally coextensive and congruent. Relevant attempts in the preform art include US, 2010/0330313 A1, 2010/0239799 A1, 2008/0257846 A1, 2012/0187067 A1, 2012/0132607 A1, 2011/0024450 A1, 2008/0257883 A1, 2010/252583 A1, 6254820, WO 9108099 and. Other attempts in the dual layer bottle art do not use preforms, and therefore have the disadvantage of more expensive and complex manufacture. Such attempts include U.S. Pat. Nos. 3,450,254, 4,330,066, 2011/0248035 A1.

Problems with plastic aerosol containers have been longstanding. For example reported bursting of plastic aerosol containers reached back to 1959. See, M. Johnsen, Ph.D., The Elusive Plastic Aerosol Part 1, SPRAY TECHNOLOGY & MARKETING, April, 2009, page 20. DOT regulations of aerosols also date back to the 1950's. Id. 1952. Exemptions were granted in 2005-2006, but only relating to certain plastic aerosols. See, M. Johnsen, Ph.D., The Elusive Plastic Aerosol Part 2, SPRAY TECHNOLOGY & MARKETING, June, 2009, pages 18-19.

One material judged suitable for a plastic aerosl is PET, which has been used for more than 30 years. Id at 17. PET is typically less expensive than PEN, but has greater permeability. Id. at 18. To overcome the permeability problem, one of skill may select a hydrocarbon propellant, as it is reported to not permeate PET. Id., The Elusive Plastic Aerosol Part 1, SPRAY TECHNOLOGY & MARKETING, April, 2009, page 22.

Once the aerosol dispenser is manufactured, shipped to retail, sold to and used by the consumer, the product in the aerosol dispenser is eventually depleted. Upon depletion, the aerosol dispenser is typically discarded. Being discarded increases landfill and fails to recycle potentially usable materials. Recycling presents an opportunity to reduce landfill, conserve energy and reuse raw materials in another aerosol dispenser or in other products. But recycling presents its own challenges.

For example, fires at recycling plants have been reported. E.g. fires have been reported to have occurred as far back as 2007 at a recycling warehouse in Dayton, Ohio and as recently as 2013 at a 4,000 ton per day plant in New Jersey.

Yet other recycling problems include separation of various material from a consumer package goods, such as an aerosol dispenser, into reusable material steams. The Society of the Plastics Industry [SPI] has developed a widely used resin identification system. The SPI system divides resins into seven classes, as set forth in below. The listing below shows each class of polymer has different melting temperatures [Tm, degrees C.], glass transition temperatures [Tg, degrees C.] and Young's moduli [YM, GPa].

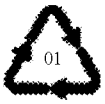

PET

Polyethylene Terephthalate (PET, PETE)

Clarity, strength, toughness, barrier to gas and moisture.

Soft drink, water and salad dressing bottles; peanut butter and jam jars

Tm=250; Tg=76

YM=2-2.7

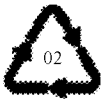

PE-HD

High-density Polyethylene (HDPE)

Stiffness, strength, toughness, resistance to moisture, permeability to gas.

Water pipes, hula hoop rings, five gallon buckets, milk, juice and water bottles; grocery bags, some shampoo/toiletry bottles Tm=130; Tg=−125

YM=0.8

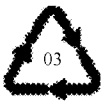

PVC

Polyvinyl Chloride (PVC)

Versatility, ease of blending, strength, toughness.

Blister packaging for non-food items; cling films for non-food use. Not used for food packaging as the plasticisers needed to make natively rigid PVC flexible are usually toxic. Non-packaging uses are electrical cable insulation; rigid piping; vinyl records.

Tm=240; Tg=85

YM=2.4-4.1

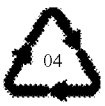

PE-LD

Low-density Polyethylene (LDPE)

Ease of processing, strength, toughness, flexibility, ease of sealing, barrier to moisture.

Frozen food bags; squeezable bottles, e.g. honey, mustard; cling films; flexible container lids.

Tm=120; Tg=−125

YM=0.17-0.28

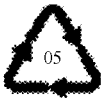

PP

Polypropylene (PP)

Strength, toughness, resistance to heat, chemicals, grease and oil, versatile, barrier to moisture.

Reusable microwaveable ware; kitchenware; yogurt containers; margarine tubs; microwaveable disposable take-away containers; disposable cups; plates.

Tm=173; Tg=−10

YM=1.5-2

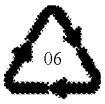

PS

Polystyrene (PS)

Versatility, clarity, easily formed

Egg cartons; packing peanuts; disposable cups, plates, trays and cutlery; disposable take-away containers;

Tm=240 (only isotactic); Tg=100 (atactic and isotactic)

YM=3-3.5

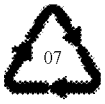

O

Other (Often Polycarbonate or ABS)

Dependent on polymers or combination of polymers

Beverage bottles; baby milk bottles. Non-packaging uses for polycarbonate: compact discs; "unbreakable" glazing; electronic apparatus housings; lenses including sunglasses, prescription glasses, automotive headlamps, riot shields, instrument panels;

Polycarbonate: Tg=145; Tm=225

Polycarbonate: YM=2.6; ABS plastics: YM=2.3

As such, it is reported that separation of the recycled materials into different classes must be efficient, because even small amounts of the wrong time of resin can be detrimental to the recycling mix. http://en.wikipedia.org/wiki/Resin identification code.

Complicating the matter, not all classes of materials are recycled in every community. Confusion can occur as to which materials can be recycled and which material cannot be recycled.

Further complicating the matter are various regulations governing manufacture and transportation of aerosol dispensers. Not all configurations which might be recycled are feasible to make or sell. The problem becomes even more complicated.

Further complicating the matter are the commonly used techniques for separating materials into various recycling streams, typically floating/sinking in liquid or IR separation. These techniques may be ineffective for small parts, as often found in an aerosol container or for parts which are chemically bonded together.

Accordingly, plastic aerosol containers must be constructed to meet the longstanding aerosol needs and to be conveniently recyclable. Such construction must go beyond the outer container which typically is the component having the largest single gram weight. Such construction must further consider the minor components and even the propellant. Accordingly, a new approach is needed.

SUMMARY OF THE INVENTION

The invention comprises an aerosol dispenser. The aerosol dispenser may be made from materials which can go into a single recycling stream having a single class of materials, as defined by the Society of the Plastics Industry. The aerosol dispenser may particularly comprise, exclusively comprise, consist essentially of or consist of Class 1 materials, with no flammable materials present.

DETAILED DESCRIPTION OF THE INVENTION

Figure 1:
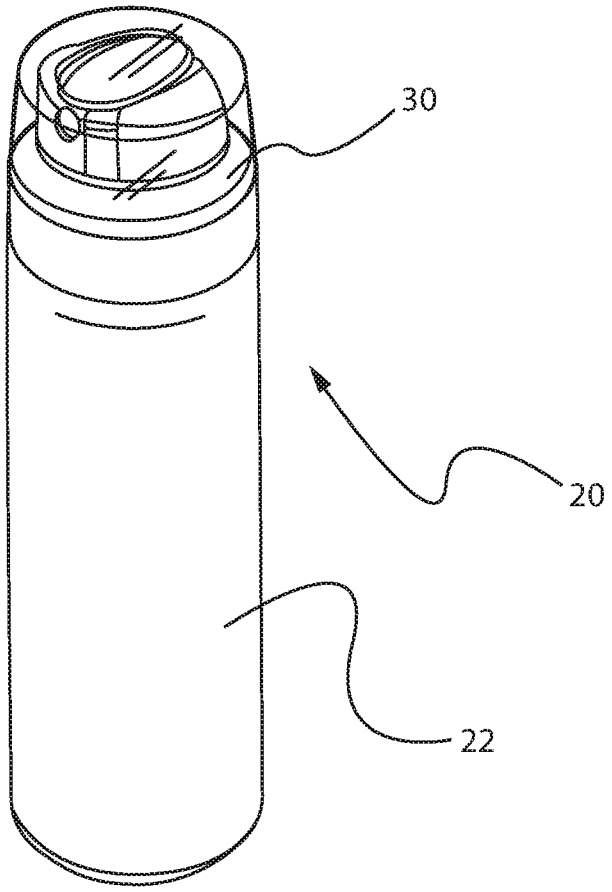
FIG. 1 is a perspective view of an aerosol dispenser according to the present invention having a plastic outer container and a bag.
Figure 2A:
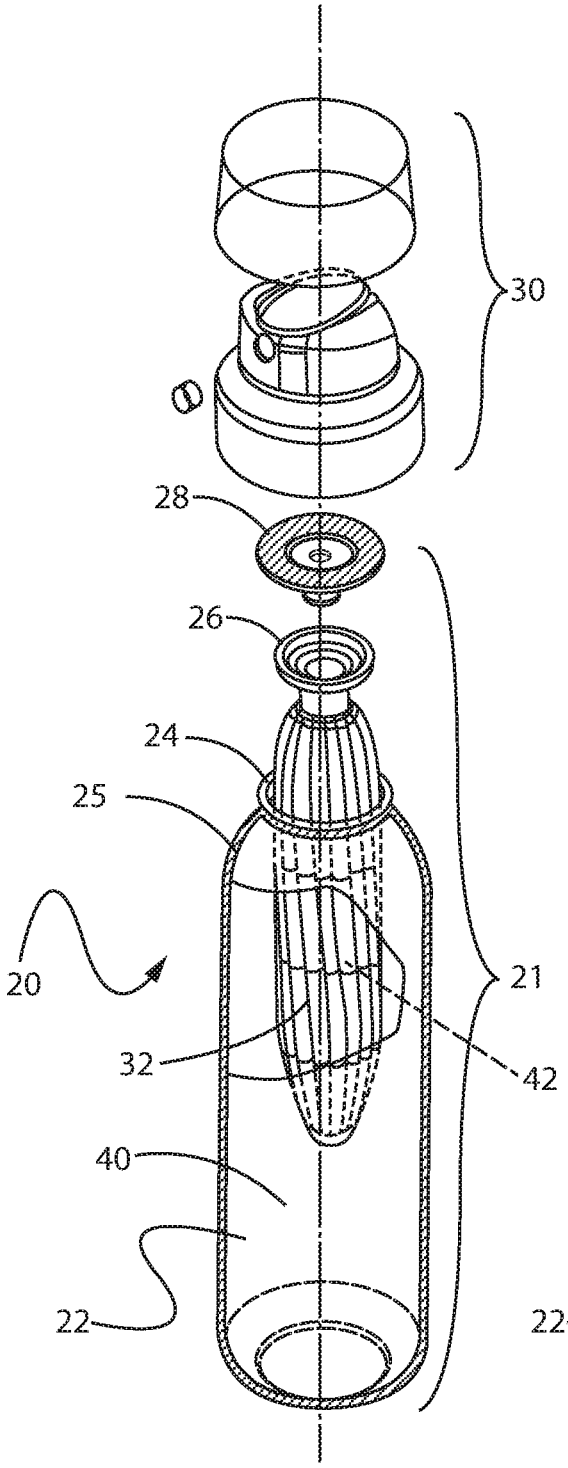
FIG. 2A is an exploded perspective view of the aerosol dispenser of FIG. 1 having a collapsible bag.
Figure 2B:
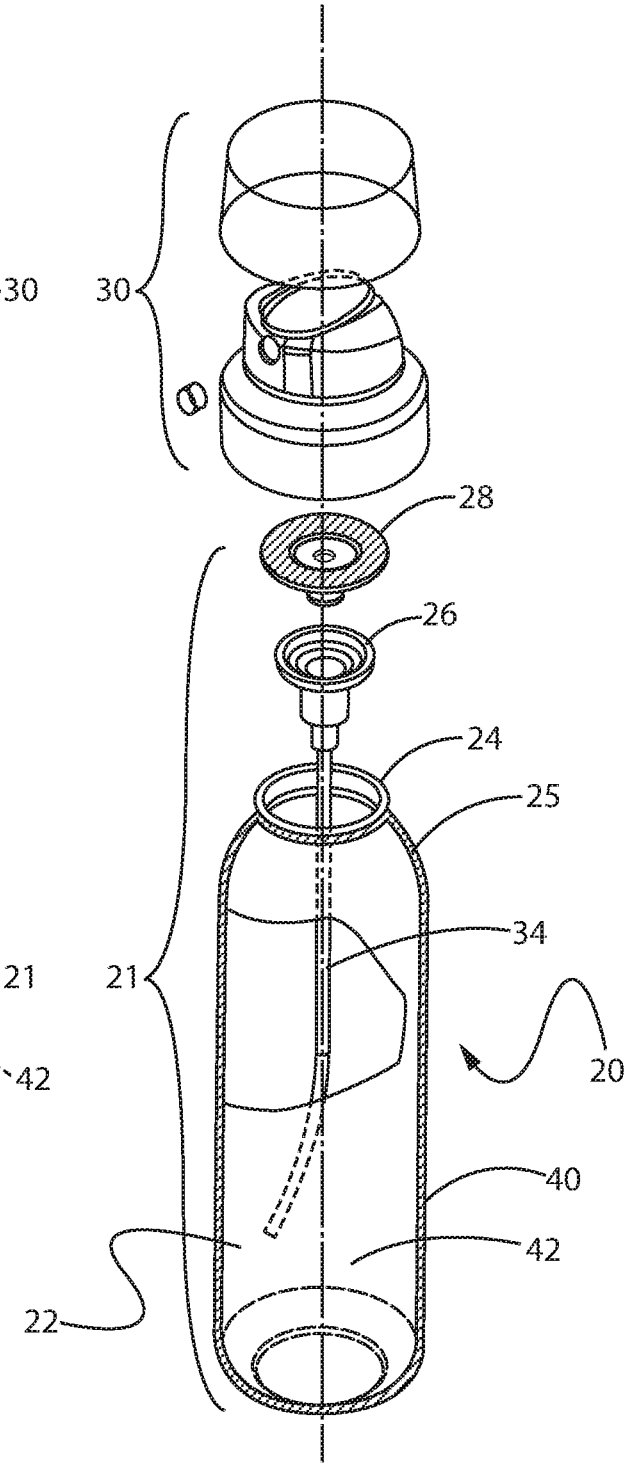
FIG. 2B is an exploded perspective view of the aerosol dispenser of FIG. 1 having a dip tube.

Referring to FIGS. 1, 2A and 2B, an aerosol dispenser 20 is shown. The aerosol dispenser 20 comprises a pressurizeable outer container 22 usable for such a dispenser. The outer container 22 may comprise plastic or metal, as are known in the art. The outer container 22 may have an opening. The opening is typically at the top of the pressurizeable container when the pressurizeable container is in its-in use position. The opening defines a neck 24, to which other components may be sealed.

A valve cup 26 may be sealed to the opening of the outer container 22, as described in further detail below. The valve cup 26 may be sealed to the neck of the outer container 22 using the same class of materials which is selected for the other components of the aerosol dispenser. Recycling class 1 thermoplastic elastomer [TPE] may be selected for the seal material.

The TPE material may be selected to be resistant to the propellant 40 and/or product 42 desired for use. A hydrophilic TPE-E based compound formulated to provide adhesion to PET and chemical resistance to silicone oil may be used as one or more components in the aerosol dispenser 20. Class 1 TPE material sold by Kraiburg TPE GmbH & Co KG of Waldkraiburg, Germany under the name Hcc8791-52 may be suitable.

A valve assembly 28, in turn, may be disposed within the valve cup 26. The valve assembly 28 provides for retention of product 42 within the aerosol dispenser 20 until the product 42 is selectively dispensed by a user. The valve assembly 28 may be selectively actuated by an actuator 30.

Selective actuation of the valve assembly 28 allows the user to dispense a desired quantity of the product 42 on demand. Illustrative and nonlimiting products 42 for use with the present invention may include shave cream, shave foam, body sprays, body washes, perfumes, cleansers, air fresheners, astringents, foods, paints, etc.

Inside the outer container 22 may be a product delivery device. The product delivery device may comprise a collapsible bag 32 as shown in FIG. 2A. The collapsible bag 32 may be mounted in sealing relationship to the neck 24 of the container and/or to the valve assembly 28. This arrangement is known in the art as a bag-on-valve. The collapsible bag 32 may hold product 42 therein, and prevent intermixing of such product 42 with propellant 40. The propellant 40 may be stored outside the collapsible bag 32, and inside the outer container 22.

The collapsible bag 32 may expand upon being charged with product 42. Such expansion decreases the available volume inside the outer container 22. Decreasing the available volume increases the pressure of any propellant 40 therein according to Boyles law.

The product delivery device may alternatively or additionally comprise a dip tube 34 as shown in FIG. 2B. The dip tube 34 extends from a proximal end sealed to the valve assembly 28. The dip tube 34 may terminate at a distal end juxtaposed with the bottom of the outer container 22. This embodiment provides for intermixing of the product 42 and propellant 40. Both are co-dispensed in response to selective actuation of the valve assembly 28 by a user. Again, insertion of product 42 and/or propellant 40 into the outer container 22 increases pressure therein according to Boyles law.

Referring to FIGS. 2A, 2B, the aerosol dispensers 20, and components thereof, may have a longitudinal axis, and may optionally be axi-symmetric with a round cross section. Alternatively, the outer container 22, product delivery device, valve assembly 28, etc., may be eccentric and have a square, elliptical or other cross section.

The outer container 22 may comprise a plastic pressurizeable container. The plastic may be polymeric, and particularly comprise PET. The valve assembly 28, and optional valve cup 26 may be welded to the neck 24 of the outer container 22, as discussed below. The valve cup 26 may be clinched to the neck 24 in known fashion.

Any number of known valve assemblies may be usable with the present invention. One suitable and non-limiting example, is shown. In this example, a rigid sleeve 54 may be attached to the top of the bag with an impermeable seal. An elastically deformable plug may be tightly inserted into the sleeve 54. Longitudinal movement of the plug, in the downward direction and within the sleeve 54 may allow product 42 to be selectively dispensed. The sleeve 54 may be impermeably joined to an optional valve cup 26. The valve cup 26, in turn, may be joined to the neck 24 of the outer container 22. A suitable plug and sleeve 54 type valve assembly 28 may be made according to the teachings of commonly assigned publications 2010/0133301A1 and/or 2010/0133295A1.

The pressurizeable container may further include a propellant 40. The propellant 40 may be disposed between the outer container 22 and the product delivery device. Alternatively propellant 40 may be disposed in the outer container 22 and/or the collapsible bag 32. Typically the pressure in the outer container 22 is greater than the pressure in the collapsible bag 32, so that product 42 may be dispensed from within the bag. If a dip tube 34 is selected for the product delivery device, the propellant 40 and product 42 may be intermixed, and thus co-dispensed. The pressure of the propellant 40 within the outer container 22 provides for dispensing of the product 42/co-dispensing of product 42/propellant 40 to ambient, and optionally to a target surface. The target surface may include a surface to be cleaned or otherwise treated by the product 42, skin, etc. Such dispensing occurs in response to the user actuating the valve assembly 28.

Examining the components in more detail, the pressurizeable container may comprise an outer container 22 having a hole with a valve cup 26 therein or disposable therein. A user activated valve assembly 28 may be disposed in the valve cup 26. A product delivery device may be joined to the valve cup 26. Propellant 40 may be disposed between the outer container 22 and the product delivery device. The product 42 and propellant 40 may be separately dispensed or may be dispensed together.

If the product delivery device comprises a flexible, collapsible bag 32, the pressure boundary for the propellant 40 is formed, in part, by the collapsible bag 32. If the product delivery device comprises a dip tube 34, the pressure boundary for the propellant 40 is formed, in part by the underside of the valve assembly 28 when the valve is closed.

If desired, the outer container 22, valve cup 26, valve assembly 28, dip tube 34 and/or collapsible bag 32 may be polymeric. By polymeric it is meant that the component is formed of a material which is plastic, comprises polymers, and/or particularly polyolefin, polyester or nylons. Thus, the entire aerosol dispenser 20 or, specific components thereof, may be free of metal, allowing exposure to microwave energy.

Thus, an aerosol dispenser 20, or pressurizable container therefor, according to the present invention may be microwaveable. Microwave heating of the aerosol dispenser 20 or pressurizable container therefor provides for heating of the product 42 prior to dispensing. Heating of the product 42 prior to dispensing may be desirable if the product 42 is applied to the skin, becomes more efficacious at lower viscosities, or is to be eaten.

If desired, the outer container 22, collapsible bag 32, and/or dip tube 34, may be transparent or substantially transparent. If both the outer container 22 and a collapsible bag 32 used as the product delivery device are transparent, this arrangement provides the benefit that the consumer knows when product 42 is nearing depletion and allows improved communication of product 42 attributes, such as color, viscosity, etc. Also, labeling or other decoration of the container may be more apparent if the background to which such decoration is applied is clear. Alternatively or additionally, the outer container 22, collapsible bag 32, etc. may be transparent and colored with like or different colors.

The outer container 22 may define a longitudinal axis of the aerosol dispenser 20. The outer container 22 may be axisymmetric as shown, or, may be eccentric. While a round cross-section is shown, the invention is not so limited. The cross-section may be square, elliptical, irregular, etc. Furthermore, the cross section may be generally constant as shown, or may be variable. If a variable cross-section is selected, the outer container 22 may be barrel shaped, hourglass shaped, or monotonically tapered.

The outer container 22 may range from 6 to 40 cm in height, taken in the axial direction and from 4 to 60 cm in diameter if a round footprint is selected. The outer container 22 may have a volume ranging from 115 to 1000 cc exclusive of any components therein, such as a product delivery device. The outer container 22 may be injection stretch blow molded. If so, the injection stretch blow molding process may provide a stretch ratio of greater than 8, 8.5, 9, 9.5, 10, 12, 15 or 20.

The outer container 22 may sit on a base. The base is disposed on the bottom of the outer container 22 and of the aerosol dispenser 20. Suitable bases include petaloid bases, champagne bases, hemispherical or other convex bases used in conjunction with a base cup. Or the outer container 22 may have a flat base with an optional punt.

A punt is a concavity in the bottom of the container and extending towards the neck 24 of the container. A punt is distinguishable from a general concavity in the bottom of a container, as a punt has a smaller diameter than is defined by the footprint of the bottom of the container. The punt may be axisymmetric about the longitudinal axis. The vertex of the punt may be coincident the longitudinal axis.

The outer container 22 sidewall also defines a diameter. The sidewall and bottom of the container may be connected by a chamfer. As used herein a chamfer refers to an angled wall which is substantially flat as taken in the radial direction. The chamfer may be angled, relative to the longitudinal axis, at least 30, 35 or 40° and not more than 60, 55 or 50°. In a degenerate case, the chamfer may be angled at 45° relative to the longitudinal axis.

If desired, the bottom of the container may comprise radially oriented internal ribs. The ribs may be of like geometry, and be spaced outwardly from the longitudinal axis. Each rib may intercept the sidewall of the outer container 22. The ribs may be equally circumferentially spaced from adjacent ribs.

It has been found that a plastic outer container 22 conforming to the aforementioned radius percentage and punt diameter to area ratio does not creep under pressures ranging from 100 to 970 kPa, and having a sidewall thickness less than 0.5 mm. The outer container 22 may be pressurized to an internal gage pressure of 100 to 970, 110 to 490 or 270 to 420 kPa. A particular aerosol dispenser 20 may have an initial propellant 40 pressure of 1100 kPA and a final propellant 40 pressure of 120 kPa, an initial propellant 40 pressure of 900 kPA and a final propellant 40 pressure of 300 kPa, an initial propellant 40 pressure of 500 kPA and a final propellant 40 pressure of 0 kPa, etc.

The aerosol dispenser 20, as presented to a user may have an initial pressure. The initial pressure is the highest pressure encountered for a particular filling operation, and corresponds to no product 42 yet being dispensed from the product delivery device. As product 42 is depleted, the outer container 22 approaches a final pressure. The final pressure corresponds to depletion of substantially all product 42, except for small residual, from the product delivery device.

Thus, a suitable outer container 22 can be made without excessive material usage and the associated cost and disposal problems associated therewith. By reducing material usage, the user can be assured that excessive landfill wasted is not produced and the carbon footprint is reduced.

The outer container 22, and all other components, except the TPE seal, may comprise, consist essentially of or consist of PET, PEN, Nylon EVOH or blends thereof to meet DOT SP 14223. Such materials may be selected from a single class of recyclable materials, as set forth above by the SPI.

The invention described and claimed herein is intended for ease of recycling. Thus it is counterintuitive that the plastic material[s] used for the outer container 22, and all other components may comprise, consist essentially of or consist of only virgin material, including regrind, again to meet regulatory requirements. All components of the aerosol dispenser, including the seal, may comprise, consist essentially of or consist of materials selected exclusively, solely and only for a single class of recyclable materials as set forth above by the SPI. Particularly, class 1 materials may be exclusively, solely and only used for the aerosol dispenser 20 of the present invention.

The outer container 22 and aerosol dispenser 20 may be nonrefillable and permanently sealed to prevent reuse without destruction/gross deformation of the aerosol dispenser 20. The outer container 22 may be permanently printed with the indium "DOT SP 14223" to show compliance.

As the top of the outer container 22 is approached, the outer container 22 may have a neck 24. The neck 24 may be connected to the container sidewall by a shoulder 25. The shoulder 25 may more particularly be joined to the sidewall by a radius. The shoulder 25 may have an annular flat. The neck 24 may have a greater thickness at the top of the outer container 22 than at lower portions of the neck 24 to provide a differential thickness. Such differential thickness may be accomplished through having an internally stepped neck 24 thickness.

The aforementioned literature states hydrocarbon propellant may be selected for use with PET due to non-permeation. Contrary to this literature, any suitable nonflammable propellant 40 may be used for the instant invention.

Likewise, the product 42 may also be inflammable. Flammability, and the absence thereof, may be determined in accordance with the absence of a fire point per ASTM D 92, Standard Test Method for Flash and Fire Points by Cleveland Open Cup Tester. The product 42 may exhibit no sustained combustion as tested in accordance with "Method of Testing for Sustained Combustibility," 49 CFR 173, Appendix H and with nonflammable propellant 40. The product 42 may comprise up to 20% by volume/15.8% by weight of ethanol and/or or isopropyl alcohol in an aqueous mix and nonflammable propellant. The product 42 may contain 4% by weight or less of an emulsified flammable liquefied gas propellant 40 within an aqueous base. The propellant 40 may remain emulsified for the life of the product 42 or else be nonflammable. It is believed this combination of factors allows an outer container 22 having a volume greater than 118 ml (4 fl. oz) to be equivalent to Class III commodities, as defined in NFPA 13, Standard for the Installation of Sprinkler Systems. In any case, in the US, NFPA 30B Code for the Manufacture and Storage of Aerosol Products should not be violated.

The propellant 40 may comprise nitrogen, air and mixtures thereof. Propellant 40 listed in the US Federal Register 49 CFR 1.73.115, Class 2, Division 2.2 are also considered acceptable. The propellant 40 may particularly comprise a Trans-1,3,3,3-tetrafluoroprop-1-ene, and optionally a CAS number 1645-83-6 gas. One such propellant 40 is commercially available from Honeywell International of Morristown, N.J. under the trade name HFO-1234ze or GWP-6.

If desired, the propellant 40 may be condensable. By condensable, it is meant that the propellant 40 transforms from a gaseous state of matter to a liquid state of matter within the outer container 22 and under the pressures encountered in use. Generally, the highest pressure occurs after the aerosol dispenser 20 is charged with product 42 but before that first dispensing of that product 42 by the user. A condensable propellant 40 provides the benefit of a flatter depressurization curve as product 42 is depleted during usage.

A condensable propellant 40 provides the benefit that a greater volume of gas may be placed into the container at a given pressure. Upon dispensing of a sufficient volume of product 42 from the space between the outer container 22 and the product delivery device, the condensable propellant 40 may flash back to a gaseous state of matter.

The valve cup 26 may have a valve cup 26 periphery complementary to the neck 24 periphery. At least one of the valve cup 26 and/or container neck 24 may have a channel 50 therethrough. Additionally or alternatively, the channel 50 may be formed at the interface between the valve cup 26 and container neck 24.

When the desired propellant 40 pressure is reached, the valve cup 26 may be sealed to the neck 24 or top of the outer container 22 to prevent leakage therefrom. If channel 50 are used in a location other than at the interface between the valve cup 26 and container neck 24, such channel 50 may likewise be sealed.

Sealing may occur through sonic welding or ultrasonic welding as are known in the art. Alternatively or additionally, sealing may occur through spin welding, vibration welding, adhesive bonding, laser welding, or fitting a plug into the port as are known in the art. If desired, the valve cup 26 and the outer container 22 may have identical, or closely matched, melt indices, to improve sealing. A welding apparatus is available from Branson Ultrasonics Corp., of Danbury Conn.

If desired, the valve cup 26 may be sealed to the container utilizing a press fit, interference fit, solvent welding, laser welding, vibration welding, spin welding, adhesive or any combination thereof. An intermediate component, such as a sleeve 54 or connector may optionally be disposed intermediate the valve cup 26 and neck 24 or top of the outer container 22. Any such arrangement is suitable, so long as a seal adequate to maintain the pressure results.

The pressurizeable container 22 may be charged with an amount of product 42 which brings the pressure, as initially presented to the user, sufficient to dispense and substantially deplete the product 42 from the aerosol dispenser 20. The final pressure, after substantially all product 42 is depleted, is less than the initial pressure.

Product 42 may be charged into the container through the valve assembly 28, as is known in the art. When product 42 is charged into the container, the product 42 increases the pressure of the propellant 40. The increase in propellant 40 pressure occurs due to the increase in volume of the collapsible bag 32 if such a bag is used as a product delivery device. Likewise, the increase in propellant 40 pressure occurs due to the increase in the number of moles of product 42 in the outer container 22 if a dip tube 34 is selected. An aerosol dispenser 20 may be made according to commonly assigned US 2012/0292338A1; US 2012/0291911A1; and/or US 2012/0291912A1.

The pressure of the propellant 40 at the end of the first phase of manufacture may correspond to the pressure at the end of the usable life of the aerosol dispenser 20, herein referred to as the final pressure. The pressure of the propellant 40 at the end of the second phase of manufacture may correspond to the pressure as initially presented to the user.

The propellant 40 may be provided at a pressure corresponding to the final pressure of the aerosol dispenser 20 when substantially all product 42 is depleted therefrom. The propellant 40 may be charged to a pressure of less than or equal to 300, 250, 225, 210, 200, 175 or 150 kPa. The propellant 40 may be charged to a pressure greater than or equal to 50, 75, 100 or 125 kPa. The gage pressures cited herein are to be construed as the initial pressure inside the outer container 22, as manufactured and prior to first use.

But not all pressures are equally suitable for an aerosol dispenser 20 intended to be conveniently recycled. Particularly, the internal gage pressure may range between any of the values shown in Table I below, for the reasons set forth therein.

TABLE I

| Gage Pressure kPa at 50 degrees C. | | | |
|---|---|---|---|
| Lower Limit | Reason Therefor | Upper Limit | Reason Therefor |
| 100 | Pressure needs to above atmospheric to dispense | 1500 | Consistency with requirements for metal cans |
| 100 | Pressure needs to above atmospheric to dispense | 1320 | Supported by FEA using compressed and nonflammable propellants |
| 140 | Judged to be the lower practical limit for low viscosity products | 1100 | DOT 2S Regulations |
| 140 | Judged to be the lower practical limit for low viscosity products | 1000 | FEA Standard X6-647 E |
| 140 | Judged to be the lower practical limit for low viscosity products | 965 | DOT non-spec Regulations |
| 210 | Judged to be the lower practical limit for low surface tension gels/lotions | 620 | Variable cross section containers may be deformed under ordinary conditions |
| 280 | Judged to be the lower practical limit for atomization or high viscosity/surface tension products | 450 | Assymmetrically shaped containers may be deform under ordinary conditions. |

But simply having the appropriate propellant 40 gage pressure may not be sufficient to make an aerosol dispenser 20 conveniently recyclable. Additionally, the total outer container 22 volume may range between any of the values shown in Table II below, for the reasons set forth therein.

TABLE II

| Volume CC | | | |
|---|---|---|---|
| Lower Limit | Reason Therefor | Upper Limit | Reason Therefor |
| 118 | Unregulated below this volume. | 1000 | Maximum volume allowed by 49 CFR 173.306 |
| 280 | Judged to be feasible lower limit | 592 | Maximum volume allowed by DOT 14097 |

The total product 42 volume, as a percentage of the outer container 22 volume, may range between any of the values shown in Table III below for the reasons set forth therein. Product 42 volume is taken to be the volume of the inner bag 32 into which the product 42 is disposed during manufacture and prior to first use.

TABLE III

| Inner Bag Percentage of Outer Container Volume % | | | |
|---|---|---|---|
| Lower Limit | Reason Therefor | Upper Limit | Reason Therefor |
| 60 | Maximum volume utilizing compressible gas propellants | 97 | Pracitical limit for nonflammable propellants |
| 60 | Maximum volume utilizing compressible gas propellants | 95 | Maximum volume allowed by DOT 49 CFR 173.306 @ 55 C. |

TABLE III-continued

| Inner Bag Percentage of Outer Container Volume % | | | |
|---|---|---|---|
| Lower Limit | Reason Therefor | Upper Limit | Reason Therefor |
| 70 | Desired volume based upon reasonable expansion volume of product and propellant | 90 | Maximum volume allowed by DOT49 CFR 173.306 @ 50 C. |

The outer container 22 may also have a maximum diameter of 3 inches [7.62 cm] in accordance with 49 CFR 306. The outer container 22 may also have a nonflammable propellant in accordance with 49 CFR 2.2.

The aerosol dispenser 20, and particularly the outer container 22 thereof, may have a burst pressure of at least 1100 kPa at 54.4 degrees C. and further may have a burst pressure of at least 1650 kPa at 20 degrees C. Meeting these burst pressures is believed to avoid the need for using DOT exemptions.

Plural valves may be used with a single outer container 22. This arrangement provides the benefit that product 42 and propellant 40 are mixed at the point of use, allowing synergistic results between incompatible materials. This arrangement also provides the benefit that delivery of the propellant 40 provides motive force to the product 42, often resulting in smaller particle size distributions. Smaller particle size distributions can be advantageous for uniform product 42 distribution and minimizing undue wetting.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" and a pressure disclosed as "about 1100 kPa" is intended to include 1103.2 kPa.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern. All limits shown herein as defining a range may be used with any other limit defining a range. That is the upper limit of one range may be used with the lower limit of another range, and vice versa.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A recyclable aerosol dispenser comprising the following components:

an outer container having a closed end bottom at a first end and an open neck at a second end and defining an outer container volume therein, a valve cup joining a collapsible inner bag to said neck, said bag being adapted to contain a product therein, a valve assembly disposed in said valve cup for selectively dispensing said product from said aerosol dispenser, a seal preventing leakage between said valve cup and said neck to ambient, wherein all of the foregoing components are selected from the group consisting of a single class of recyclable materials as defined by the Society of the Plastics Industry, said outer container having a diameter less than or equal to about 7.62 cm, said outer container having a volume ranging from about 118 cc to about 1000 cc, and a nonflammable propellant, said nonflammable propellant having a gage pressure of less than about 1100 kPa @ 50C.

2. A recyclable aerosol dispenser according to claim 1 wherein each said component selected from a single class of recyclable materials is selected from Class 1 recyclable materials.

3. A recyclable aerosol dispenser according to claim 2 wherein said gage pressure is less than about 965 kPA @ 50C.

4. A recyclable aerosol dispenser according to claim 3 wherein said gage pressure is less than about 620 kPa @ 50C.

5. A recyclable aerosol dispenser according to claim 3 wherein said outer container has a volume ranging from about 280 to about 592 cc.

6. A recyclable aerosol dispenser comprising the following components:

an outer container having a closed end bottom at a first end and an open neck at a second end and defining an outer container volume therein, a valve cup sealed to said neck, an inner bag defining an inner bag volume therein and having a sprayable product therein, said inner bag being joined to said valve cup, a valve assembly disposed in said valve cup for selectively dispensing said sprayable product from said inner bag, wherein all of the foregoing components are selected from the group consisting essentially of class 1 recyclable materials as defined by the Society of the Plastics Industry, said outer container having a volume between about 118 cc and about 1000 cc, said inner bag having an inner bag volume less than or equal to about 97% of said outer container volume prior to first use, and a nonflammable propellant intermediate said outer container and said inner bag, said nonflammable propellant having a gage pressure of less than about 1100 kPa @50C.

7. An aerosol dispenser according to claim 6 wherein said outer container consists essentially of PET.

8. An aerosol dispenser according to claim 1 wherein said seal comprises TPE.

9. An aerosol dispenser according to claim 8 wherein said seal consists essentially of a hydrophilic TPE-E based compound.

10. An aerosol dispenser according to claim 6 wherein said inner bag has an inner bag volume between about 60 to about 95% of said outer container volume prior to first use.

11. An aerosol dispenser according to claim 10 wherein said inner bag has an inner bag volume between about 70 to about 90% of said outer container volume prior to first use.

12. A recyclable aerosol dispenser comprising the following components:

an outer container having a closed end bottom at a first end and an open neck at a second end and defining an outer container volume therein, a valve cup joining an inner bag to said neck, a valve assembly disposed in said valve cup for selectively dispensing a product from said aerosol dispenser, a seal preventing leakage through said neck to ambient, said outer container having a diameter less than or equal to about 7.62 cm, said outer container having a volume ranging from about 118 cc to about 1000 cc, and a nonflammable propellant, said nonflammable propellant having a gage pressure of less than about 1100 kPa @ 50C, wherein all of the foregoing components are selected from the group consisting essentially of a single class of recyclable materials as defined by the Society of the Plastics Industry, and each of the foregoing components consists essentially of virgin material or regrind thereof.

13. A recyclable aerosol dispenser according to claim 12 further comprising said product therein, said product comprising not more than about 15.8 weight percent of ethanol and/or or isopropyl alcohol in an aqueous mix.

14. A recyclable aerosol dispenser according to claim 13 wherein said product and said propellant are intermixed within said outer container.

15. A recyclable aerosol dispenser according to claim 14 further comprising a dip tube communicating from said outer container to said valve assembly for dispensing of said intermixed product and propellant.

16. A recyclable aerosol dispenser according to claim 12 further comprising indicium on the outside of said outer container indicating said aerosol dispenser complies with DOT SP 14223.

17. A recyclable aerosol dispenser according to claim 12 wherein said propellant comprises a Trans-1,3,3,3-tetrafluoroprop-1-ene.

18. A recyclable aerosol dispenser according to claim 17 having a volume ranging from about 280 to about 592 cc.

19. A recyclable aerosol container according to claim 17 further comprising said product in said inner bag, so that said product is in communication with said valve assembly, and said product is separated from said propellant, said inner bag having a volume ranging from about 60% to about 90% of said volume of said outer container volume.

20. A recyclable aerosol container according to claim 19 wherein said propellant has a pressure ranging from about 210 to about 965 kPa @ 50C.

* * * * *